United States Patent [19]

Rosser

[11] Patent Number: 4,660,815

[45] Date of Patent: Apr. 28, 1987

[54] PRESSURE ACTUATED CLAMP FOR TRUSS MANUFACTURING EQUIPMENT

[75] Inventor: Michael C. Rosser, Roanoke, Tex.

[73] Assignee: Production Equipment & Engineering Co., Fort Worth, Tex.

[21] Appl. No.: 656,513

[22] Filed: Oct. 1, 1984

Related U.S. Application Data

[63] Continuation-in-part of Ser. No. 570,024, Jan. 11, 1984, Pat. No. 4,570,913.

[51] Int. Cl.[4] ..... B30B 15/00

[52] U.S. Cl. ..... 269/22; 269/157; 269/910

[58] Field of Search ..... 269/20, 22, 25, 157–163, 269/253, 910; 254/93 HP; 29/281.3; 180/8.1–8.7

[56] References Cited

U.S. PATENT DOCUMENTS

| | | | |
|---|---|---|---|
| 965,807 | 7/1910 | Garvey | 269/25 |
| 3,446,301 | 5/1969 | Thomas | 180/8.5 |

FOREIGN PATENT DOCUMENTS

| | | | |
|---|---|---|---|
| 314721 | 8/1956 | Switzerland | 269/22 |

*Primary Examiner*—Robert C. Watson

*Attorney, Agent, or Firm*—John F. Booth; Gerald G. Crutsinger; Norman L. Gundel

[57] ABSTRACT

A clamping apparatus is disclosed for use in clamping wooden chord and web members together in manufacturing wooden trusses. The clamping apparatus uses an inflatable conduit (50) to force an elongated clamp to a closed position. In a second embodiment, two inflatable conduits (150 and 152) move a tubular member (136) in opposite directions for urging a truss (120) against a stationary brace (32). Tubes (150 and 152) are selectively inflated and deflated through a valve (170).

6 Claims, 6 Drawing Figures

PRESSURE ACTUATED CLAMP FOR TRUSS MANUFACTURING EQUIPMENT

CROSS REFERENCE TO RELATED APPLICATION

This application is a continuation-in-part of my copending application Ser. No. 06/570,024 filed Jan. 11, 1984, now U.S. Pat. No. 4,570,913, entitled "Clamping Apparatus For Truss Manufacturing Equipment."

TECHNICAL FIELD

The present invention relates generally to apparatus for assembling pre-cut wooden chord and web members into floor and roof trusses by use of metal plate connectors. More particularly, this invention concerns a pressure actuated clamping apparatus for positioning the chord and web members during assembly of the truss.

BACKGROUND ART

Prefabricated wooden trusses are being utilized in the construction industry. Such trusses are typically assembled at a manufacturing facility and then transported to the job site for incorporation into the building. The use of these prefabricated structures can result in substantial cost saving by decreasing the time and labor required to complete a project. In addition, these trusses are generally lighter in weight and more efficiently engineered than on-the-site assembled trusses.

Prefabricated wooden truss rafters for use as floor or roof supports are examples of components which are pre-assembled and used widely in the construction industry. Such trusses are assembled from pre-cut wooden chord and web members positioned in an abutting relationship and connected together by metal connector plates.

Although trusses of this type can be fabricated by hand on a production line basis, several truss assembly machines have been developed for performing this task in a semiautomated manner. One such machine is disclosed in prior U.S. Pat. No. 4,295,269 to Wright. In general, this patent discloses a device in which pre-cut wooden members are positioned manually over a support or work table. The members are clamped in place after which a toothed metal fastener is laid over the abutting joints. The fastener plates are pressed into the wooden members to secure the joints while the members are held by clamping assembly.

Various arrangements of tables and clamping assemblies have been employed in the prior art such as those shown in the above mentioned U.S. Pat. No. 4,295,269, and the patents cited therein. Typically, the truss components are laid flat on a table and abutted against a fixed brace. A clamping assembly is positioned on the opposite side of the truss and is movable between an open and closed position. In the open position, sufficient space is provided between the fixed brace and the clamping assembly to allow placement of the truss components therebetween. In a closed position, the clamp closes on the truss components and clamps or presses them against the fixed brace. In the prior art, this clamping means comprised an elongated bar of a sufficient length to contact one side of the truss and a mechanical device such as a screw, lever or toggle means is provided to apply closing force to the elongated member at spaced points. In other prior art devices, pneumatic or hydraulic cylinders contact the elongated member at spaced points and apply force thereto. The prior art clamping apparatus which contact the elongate member at space points can in some cases tend to deform the elongate member and truss assembly itself. This limits the capability of the prior art truss manufacturing devices.

SUMMARY OF THE INVENTION

The present invention comprises an apparatus for clamping wooden truss chord and web members in position which overcomes the foregoing difficulties associated with the prior art. In accordance with the invention, there is provided a truss clamping apparatus including a truss assembly table with a fixed brace against which the one side of the truss abuts.

Two embodiments of movable clamping means are provided, the first embodiment having a fixed elongated L shaped member with one flange of the L bolted to the surface of the table. A second L shape bracket is resiliently connected to the first L shape bracket and has a surface thereon for contacting the other side of the wooden truss. Positioned between the two elongated L shape brackets is an inflatable conduit preferably of resilient material. Pneumatic supply and control means are provided for selectively inflating the conduit to cause the second L shape bracket to be forced in a clamping direction away from the first L shape bracket.

The second embodiment of the clamping apparatus comprises a first tubular member extending through a second tubular member and dividing the interior of the second tubular member into two cavities. The first tubular member is anchored to the surface of the table and the second tubular member is shifted laterally in a direction parallel to the surface of the table by inflatable conduits extending through the chambers which are alternately inflated and deflated.

The advantage of this device is that the inflatable conduit provides a uniform pressing force along its length as it is inflated. There are no discrete pressure points where hydraulic cylinders, mechanical screws or the like contact the movable L shape bracket and therefore distortions in the L shape bracket contacting the truss are minimized if not completely eliminated. A spring return means is provided between the two L shape brackets to resiliently return the second L shape bracket to the open position when the pressure is removed from the inflatable conduit.

BRIEF DESCRIPTION OF THE DRAWINGS

A more complete understanding of the present invention can be had by referring to the following detailed description in conjunction with the accompanying drawings wherein.

DETAILED DESCRIPTION

Figure 1:
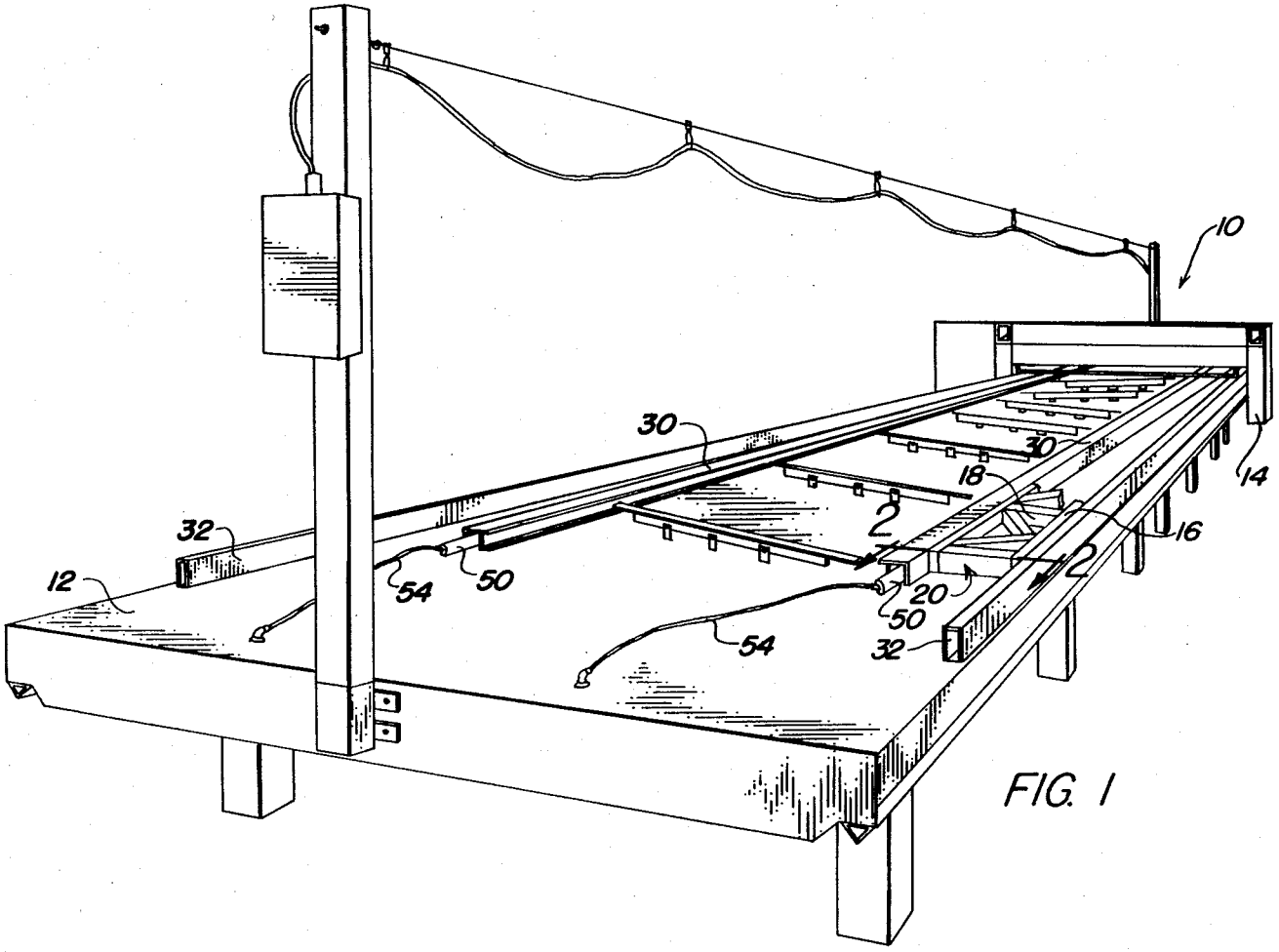
FIG. 1 is a top perspective view of a truss assembly apparatus table with the clamping apparatus of the present invention installed thereon.

Referring now to the drawings, wherein identical reference numerals designate like or corresponding parts throughout the several views, and particularly to FIG. 1, there is shown a truss assembly apparatus 10 embodying the improved clamping apparatus of the present invention.

The apparatus 10 is of the type shown in U.S. Pat. No. 4,295,269, and comprises a jig table 12 and a presser carriage 14 supported for movement therealong. The table 12 rests on the floor and forms a flat elongated planar work surface thereon. As is described in U.S. Pat. No. 4,295,269, the presser carriage 14 straddles the table 12 and is supported for powered movement along the table. Presser carriage 14 has a roller not shown for pressing metallic toothed or barbed fastener or nail plates into the chord 16 and web member 18 of a wooden truss 20. The pointed metal fastener plates 22 are utilized to connect the wooden components of the truss together.

According to a particular feature of the present invention, the table 12 has a pair of the improved clamping assemblies 30 thereon. Clamping assembly 30 is utilized to clamp the truss 20 against an outer brace 32. Brace 32 is affixed on the table 12. In the present embodiment, the outer brace comprises a metallic square tubular member extending along the length of the table 12.

According to a particular feature of the present invention, the clamping assembly 30 comprises an elongated clamping member which likewise extends along the length of the table as shown. The clamping assembly 30 is shown in detail in FIG. 2 and comprises a first elongated L shape bracket 34 and a second elongated L shape bracket 36. The brackets 34 and 36 are made from metallic material such as steel which has a sufficient rigidity to accommodate the clamping forces applied by the clamping assembly.

The L shape bracket 34 has one flange **34*a* resting upon the surface of the table 12 and is rigidly affixed in position by bolts 38 which engage threaded openings not shown in the surface of the table 12. By providing a plurality of threaded openings in the table, the bracket 34 can be bolted down upon the surface of the table in various positions to accommodate various sizes of trusses. The elongated bracket 34 has a second flange 34*b* which extends up from the surface of the table 12 in a direction transverse to the work surface. This flange 34*b* in the embodiment shown has a plurality of spaced pairs of clearance openings 40 formed therein for receiving guide rods 42. Rods 42 extend from the bracket 36**.

Bracket 36 has a flange **36*a* which rests on the surface of the table 12 and a flange 36*b* which rests upon the upper end of flange 34*b*. Both the flanges 36*a* and 36*b* slide with respect to the table and the flange 34*b* in the forward and reverse direction of arrow 44. The guide rods 42 slide in the clearance openings 40 to assist in maintaining the bracket 36 in proper position. A compression spring 46 is mounted around the guide rod 42. Retainer means 48 are attached to the guide rods to mount the springs thereon. The springs 46 contact the flange 34 and resiliently urge the guide rods 42 in the reverse direction of arrow 44**.

According to a particular feature of the present invention, an elongated resilient inflatable conduit 50 is positioned within the elongated cavity 52 formed between the flanges **36*a*, 36*b*, 34*b*, and the upper surface of the table 12. The conduit can be made from collapsible air hose. This conduit 50 is sealed at both ends and is coupled to a suitable supply of pressurized gas such as air as shown in FIG. 1 by air hose 54. It is to be understood, of course, that a suitable pump, reservoir and valve means can be provided for selectively controlling the supply of pressurized air to the inflatable conduit 50**.

The operation of the clamping assembly 30 can best be described by reference to FIGS. 2 and 3. In FIG. 3, the clamp assembly 30 is shown in the open position with the conduit 50 compressed to a constricted or collapsed position by the action of the springs 46. To close the clamp assembly 30, pressurized air is supplied through a suitable valve to the interior of the conduit 50 which in turn inflates the conduit to the position shown in FIG. 2. This inflation of the conduit 50 causes the bracket 36 to move in the direction of the arrow 44 and contact the cord 16 of the truss 20 and compress the truss against the bracket 32.

By reason of the fact that the conduit 50 is inflatable and maintained at a uniform pressure, the force of the conduit exerted between the flange **34*b* and 36*a* is uniform along the length of the clamp assembly 30. This eliminates deformations in the movable bracket 36** caused in conventional systems by the spaced contact points with the pneumatic cylinder or other actuating means.

Figure 2:
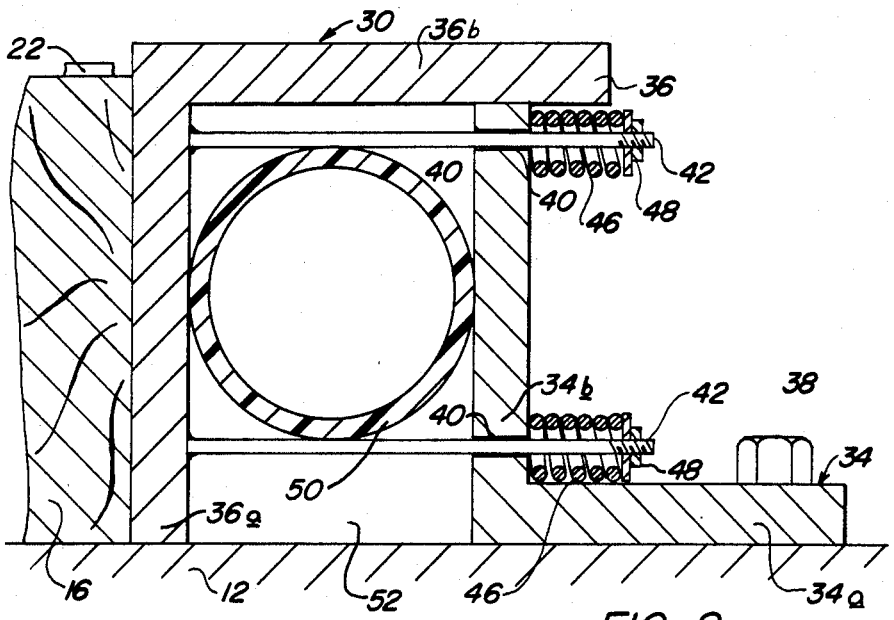
FIG. 2 is an enlarged partial sectional view taken along line 2—2 of FIG. 1 looking in the direction of the arrows showing the clamping apparatus in the closed position.
Figure 3:
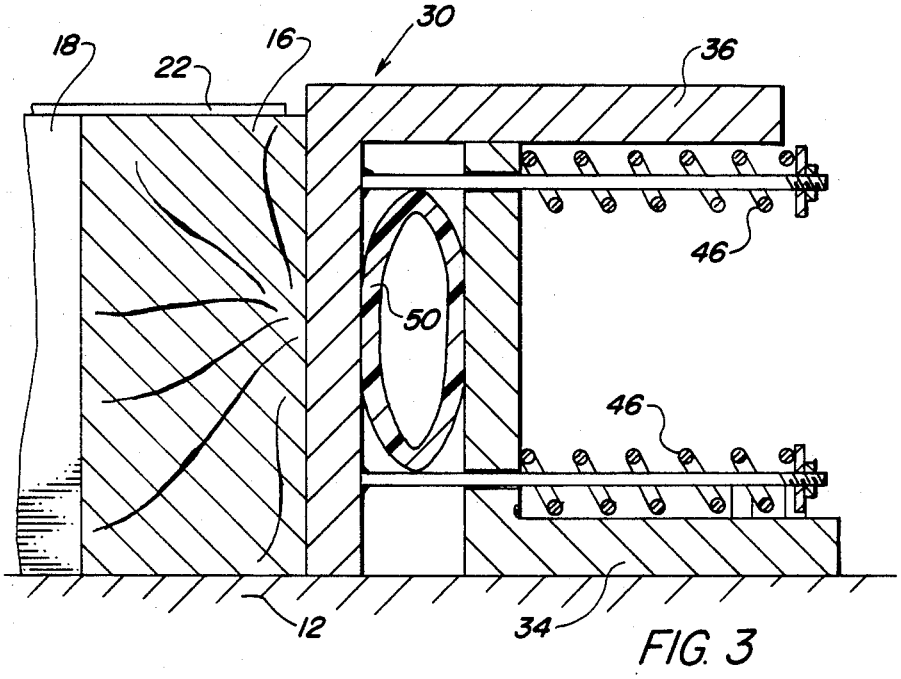
FIG. 3 is a view similar to FIG. 2 showing the clamping apparatus of the present invention in the open position.

To return the clamp from the closed position shown in FIG. 2 to the open position shown in FIG. 3, the valve (not shown) is opened to release the pressure from the interior of the conduit whereby the conduit 50 is vented to an atmospheric pressure and compressed by springs 46.

SECOND EMBODIMENT

Figures 4, 6:
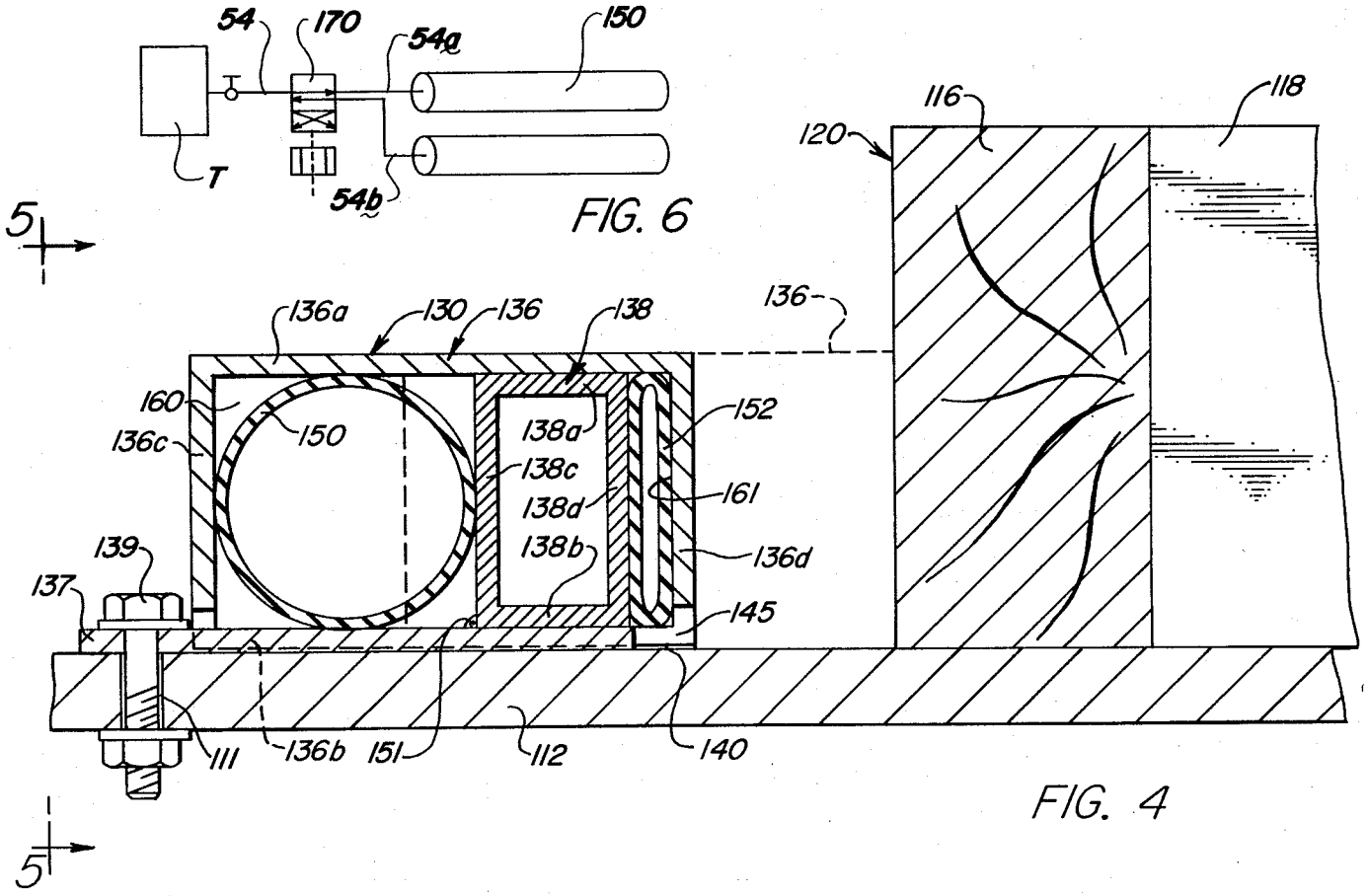
FIG. 4 is an enlarged partial sectional view similar to FIG. 3 of a second embodiment of the clamping apparatus; taken along line 4—4 of FIG. 5 looking in the direction of the arrows showing the clamping apparatus in the open position.
FIG. 6 is a diagrammatic view showing valving associated with two inflatable tubes of the second embodiment.

A second embodiment of the improved clamping assembly is generally designated by numeral 130 in FIG. 4 of the drawings. A pair of clamping assemblies 130 are employed in lieu of clamping assemblies 30 and are utilized to clamp the truss 120 against an outer brace 32 as illustrated in FIG. 1.

Figure 5:
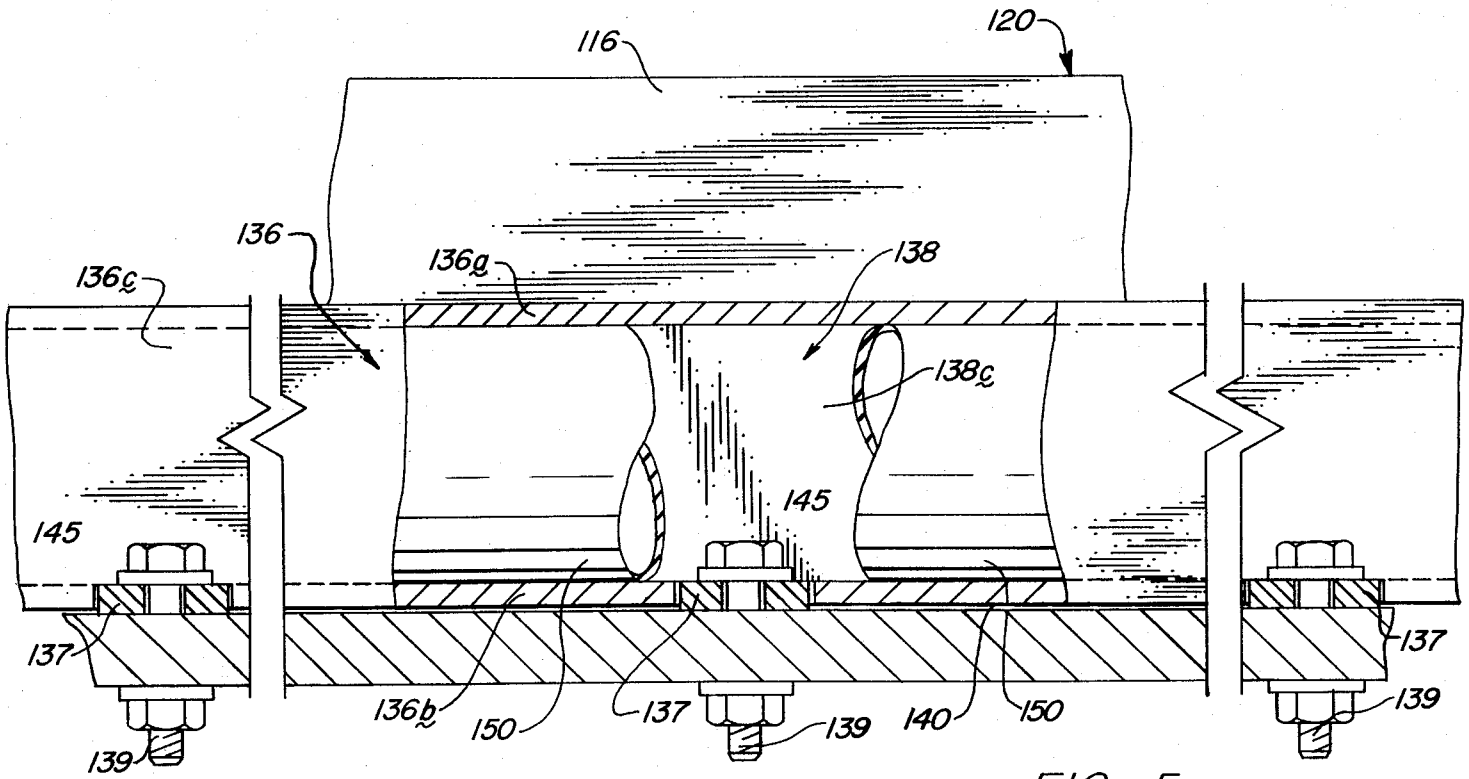
FIG. 5 is a fragmentary cross-sectional taken along line 5—5 of FIG. 4, parts being broken away to more clearly show details of construction.

The clamping assembly 130 comprises an elongated clamping member which extends along the length of the table 112. The clamping assembly 130, shown in cross sectional detail in FIGS. 4 and 5, comprises a first elongated hollow outer tubular member 136 and a second elongated hollow inner tubular member 138. Members 136 and 138 are preferably made from metallic material such as steel which has sufficient rigidity to accommodate the clamping forces which are applied by the clamping assembly.

Tubular members 136 and 138 have rectangular cross-sections as best illustrated in FIG. 4. The outer rectangular tubular member 136 has horizontal upper and lower tube walls **136*a* and 136*b* and vertical tube side walls 136*c* and 136*d*. The inner rectangular tubular member 138 has upper and lower tube walls 138*a* and 138*b* and vertical side walls 138*c* and 138*d*. Inner tube 138 extends through outer tube 136 such that the upper surface on tube wall 138*a* on inner tube 138 is in sliding relation with the inner surface on upper tube wall 136*a*** on outer tube 136. Spaced connector plates 137 are secured by machine welds 151 to lower wall 138*b* of hollow inner tubular member 138. The connector plates 137 are rigidly affixed in position atop table 112 by bolts 139 which extend into openings 111 in the surface of table 112. By providing a plurality of openings in the table, the hollow tubular member 138 can be bolted down upon the surface of the table in various positions to accommodate various sizes of trusses.

The lower tube wall 136*b* of hollow tubular member 136 is spaced from the surface of the table 112 such that tube 136 does not frictionally engage table 112. Connector plates 137 are slidably disposed in spaced slots 145 formed in bottom wall 136*b* of outer tube 136 and have a thickness greater than the thickness of bottom wall 136*b* to provide space 140 between the lower surface of bottom wall 136*b* and the upper surface of the table 112.

Member 138, located inside of hollow tubular member 136 is made proportionally to fit directly into outer member 136 such that surfaces 136*a* and 138*a* and surfaces 136*b* and 138*b* are in sliding relation while surfaces 136*c* and 138*c* and surfaces 136*d* and 138*d* are spaced apart to form cavities 160 and 161. On each side of member 136 and inside member 138 are elongated resilient inflatable conduits 150 and 152, one on each side of inner member 138 in cavities 160 and 161, respectively. As shown in FIG. 4, conduit 150 is inflated to move outer tube 136 to an open position and conduit 152 is deflated.

The conduits can be made from collapsible tubing such as an air hose and are sealed at both ends. Conduits 150 and 152 are coupled to a suitable supply of pressurized gas, such as a compressed air tank T which is shown in FIG. 6 by air hose 54. It is to be understood, of course, that a suitable pump, reservoir and valve means can be provided for selectively controlling the supply of pressurized air to selectively inflatable conduits 150 and 152. Valve 170 is preferably a four-way, two-position solenoid actuated valve. In the first position illustrated in FIG. 6, pressurized fluid is delivered from air hose 54 through valve 170 and hose 54*a* to inflatable conduit 150, while conduit 152 is vented through line 54*b* and valve 170. When valve 170 is shifted to the second position, conduit 152 is inflated and conduit 150 is deflated.

The operation of the clamping assembly 130 can best be described by reference to FIG. 4. In FIG. 4, clamp assembly 130 is in the open position where conduit 150 is inflated and conduit 152 is deflated and compressed. In this open position, truss members 116 and 118 can be put in their respective places as shown in FIG. 1. Clamp assembly 130 now is supplied with pressurized air through a suitable valve to inflate the conduit 152 and vent conduit 150 which compresses conduit 150 and moves clamping assembly 130 to the closed position as illustrated in dashed outline. This inflation of the conduit 152 causes the outer tubular member 136 to move to the right as viewed in FIG. 4 and compresses against the truss member 116 which in turn compresses truss member 118 against bracket 32 as shown in FIG. 1.

By reason of the fact that the conduit 152 is inflatable and maintained at a uniformed pressure, the force of the conduit exerted between the tubular members 136 and 138 is uniform along the length of the clamp assembly 130. Deformations are eliminated in the movable hollow tube 136 which would be caused in conventional systems by spaced contact points with a pneumatic cylinder or other actuating means.

To return the clamp assembly from the closed position shown in dashed outline back to the open position as shown in full outline in FIG. 4, conduit 150 is reinflated with pressurized air and concurrently pressure in conduit 152 is released by a valve (not shown) whereby conduit 152 is vented to atmospheric pressure.

From the foregoing, it will be understood that the present invention comprises an improved double acting clamping apparatus for use in truss assembly devices and that the clamping apparatus provides a uniform force along the length hereof thus providing advantages over the prior art. Although the device is shown in the two preferred embodiments illustrated, it is intended to embrace any alternative modifications and rearrangements and/or substitution of elements that fall within the spirit and scope of the invention. For example, other shapes of brackets and guide means could be utilized with inflatable conduits to provide the uniform pressure of the present invention.

I claim:

1. A clamping apparatus operable by a controlled pneumatic source for use on a table in fabricating wood trusses having chords and web components joined together by metal plates comprising:

a first bracket means, means for releasably fixing said first bracket means to the surface of the table, a second elongated bracket means positioned on each of two opposite sides of said first bracket means for engaging a chord of said wood truss, means for movably supporting said second bracket means from the surface of said table, a first elongated inflatable conduit positioned between said first and second bracket means, said first conduit being inflatable between a constricted and inflated position whereby said first conduit when inflated, forces said second bracket means to move in a direction away from said first bracket means to engage the chord of said wood truss and a second elongated inflatable conduit positioned between said first and second bracket means opposite of said first conduit, said second conduit being inflatable between a constricted and inflated position whereby said second conduit when inflated, forces said second bracket means in a direction away from said truss.

2. The clamping apparatus of claim 1 additionally comprising stop means limiting the movement of said second bracket means in a direction away from said first bracket means.

3. A clamping apparatus operable by a controlled pneumatic source for use on a table in fabricating wood trusses having chords and web components joined together by metal plates comprising:

a first bracket means, means for releasably fixing said first bracket means to the surface of the table, a second elongated bracket means for engaging a chord of said wood truss, means for movably supporting said second bracket means from the surface of said table, and an elongated inflatable conduit positioned between said first and second bracket means, said conduit being inflatable between a constricted and inflated position whereby said conduit when inflated, forces said second bracket means to move in a direction away from said first bracket means to engage the chord of said wood truss, said second bracket means comprising a hollow tubular member having a rectangular cross-section, said first bracket means extending through said hollow tubular member to form first and second cavities extending longitudinally through the hollow tubular member; said elongated inflatable conduit extending through said first cavity; a second inflatable conduit extending through said second cavity; and means to selectively inflate said conduits to move said tubular member relative to said first bracket means.

4. An apparatus for fabricating wood trusses having chords and web components joined together by toothed metal plates comprising:

a rigid truss assembly table forming a work surface for receiving truss components thereon, at least one clamping assembly for engaging the chords of the truss components, said assembly comprising: first means fixed to said table for engaging said truss, second means fixed to said table and spaced from said first means and movable to engage said truss and clamp said truss between said first and second means, said second means comprising an elongated first bracket removably connected to said table, a flange on said elongated first bracket extending transverse to the work surface of the table, an elongated second bracket, a flange on said second bracket extending transverse to the work surface of said table and positioned on each of two opposite sides of said flange on said elongated first bracket and supply means for providing a control supply of pressurized compressible gas, a first inflatable conduit positioned between said flanges on said first and second brackets and connected to said supply means, said first conduit being inflatable between expanded and constricted positions, said first conduit when inflated from said constricted to said expanded position causing said second bracket to move in a direction away from said first bracket whereby said second bracket contacts and clamps said truss against said first means and a second elongated inflatable conduit positioned between said first and second brackets opposite of said first conduit, said second conduit being inflatable between a constricted and inflated position whereby said second conduit when inflated, forces said second bracket in a direction away from said truss.

5. A clamping apparatus operable by a controlled pneumatic source for use on a table in fabricating wood trusses having chords and web components joined together by metal plates comprising:

an elongated hollow outer tubular member;

an elongated inner member extending through said outer tubular member, said outer tubular member having a rectangular cross-section and a central passage divided by said inner member to form a pair of longitudinally extending cavities;

a pair of elongated inflatable conduits in said cavities;

a source of pressurized gas; and means to selectively connect said source of pressurized gas to said conduits to reciprocate said hollow outer tubular member relative to said inner member and toward and away from a position in which a pressing force is applied substantially uniformly along the length of said chords.

6. A clamping apparatus operable by a controlled pneumatic source for use on a table in fabricating wood trusses having chords and web components joined together by metal plates comprising:

a hollow outer tubular member;

an inner member extending through said outer tubular member, said outer tubular member having a rectangular cross-section and a central passage divided by said inner member to form a pair of longitudinally extending cavities;

a pair of inflatable conduits in said cavities;

a source of pressurized gas; and means to selectively connect said source of pressurized gas to said conduits to reciprocate said hollow outer tubular member relative to said inner member, said outer hollow tubular member having spaced openings formed therein; and spaced connector plates secured to said inner member, said connector plates extending through said spaced openings and having a thickness greater than the thickness of the wall of the tubular member to space the tubular member from the table surface.

* * * * *